United States Patent [19]

Krimsky et al.

[11] 4,102,511

[45] Jul. 25, 1978

[54] TURRET FOR WINDERS AND UNWINDERS

[75] Inventors: Leonard C. Krimsky, Spring Valley; Henk Van Rietschoten, Monroe, both of N.Y.

[73] Assignee: Worldwide Converting Machinery, Inc., Allendale, N.J.

[21] Appl. No.: 639,970

[22] Filed: Dec. 11, 1975

[51] Int. Cl.[2] ..... B65H 19/06

[52] U.S. Cl. ..... 242/64; 242/68.4

[58] Field of Search ..... 242/64, 58, 68.4, 56 A, 242/129.51, 129.53, 58.6, 78.1, 79; 308/6 C

[56] References Cited

U.S. PATENT DOCUMENTS

| | | | |
|---|---|---|---|
| 1,980,879 | 11/1934 | Roesen | 242/64 |
| 2,405,637 | 8/1946 | Behrens | 242/68.4 |
| 2,714,996 | 8/1955 | Stroehman | 242/58.6 |
| 3,204,887 | 9/1965 | Hansen et al. | 242/64 |
| 3,331,318 | 7/1967 | Augustyn et al. | 242/68.4 X |
| 3,343,760 | 9/1967 | Haskin et al. | 242/58.6 |
| 3,584,808 | 6/1971 | Staples et al. | 242/68.4 |
| 3,655,247 | 4/1972 | Grover | 308/6 C |
| 3,695,539 | 10/1972 | Lindstaedt | 242/58.6 |
| 3,907,385 | 9/1975 | Bartenstein | 308/6 C |

*Primary Examiner*—Harvey C. Hornsby
*Assistant Examiner*—John M. Jillions
*Attorney, Agent, or Firm*—Shenier & O'Connor

[57] ABSTRACT

An improved turret for use in winding and unwinding operations in which each of the arms of two pairs of generally diametrically oppositely extending roll supporting arms is eccentrically mounted on the cross-shaft by linear bearings which permit rolling movement of an arm axially of the cross-shaft while constraining the arm to rotate with the shaft. Respective independently operable means associated with each pairs of arms permit the arms of a pair to be moved concomitantly axially toward or away from each other to accommodate different roll widths. Other independently operable means permit the arms of a pair to be moved together axially from side to side to adjust side lay of the web being handled.

8 Claims, 7 Drawing Figures

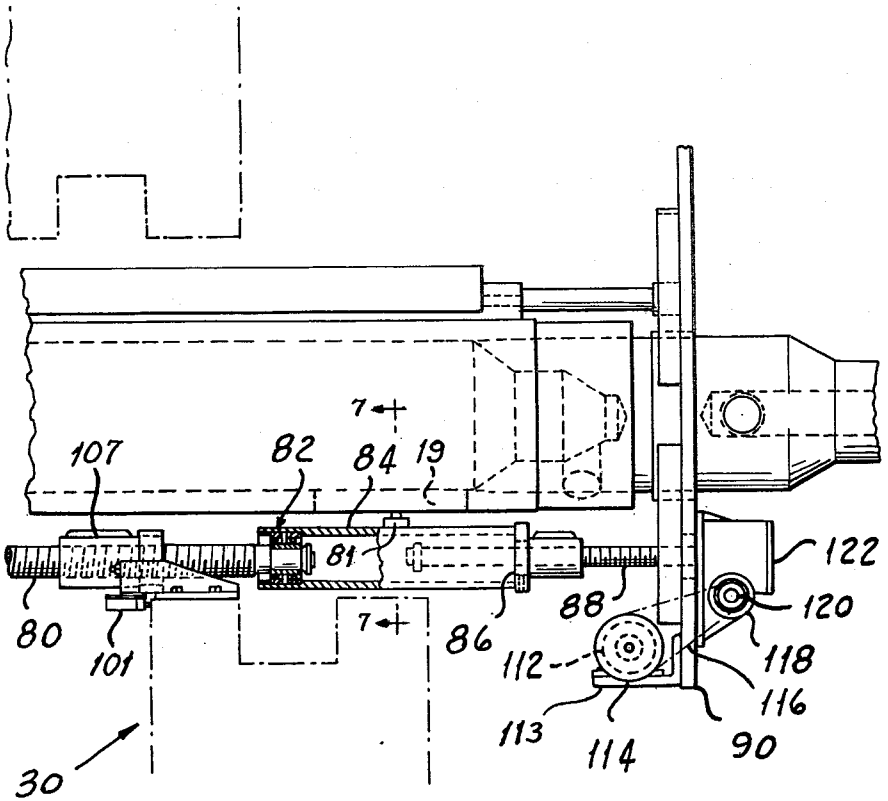
FIG. 5
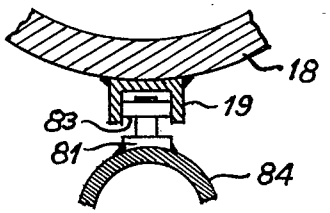
FIG. 7
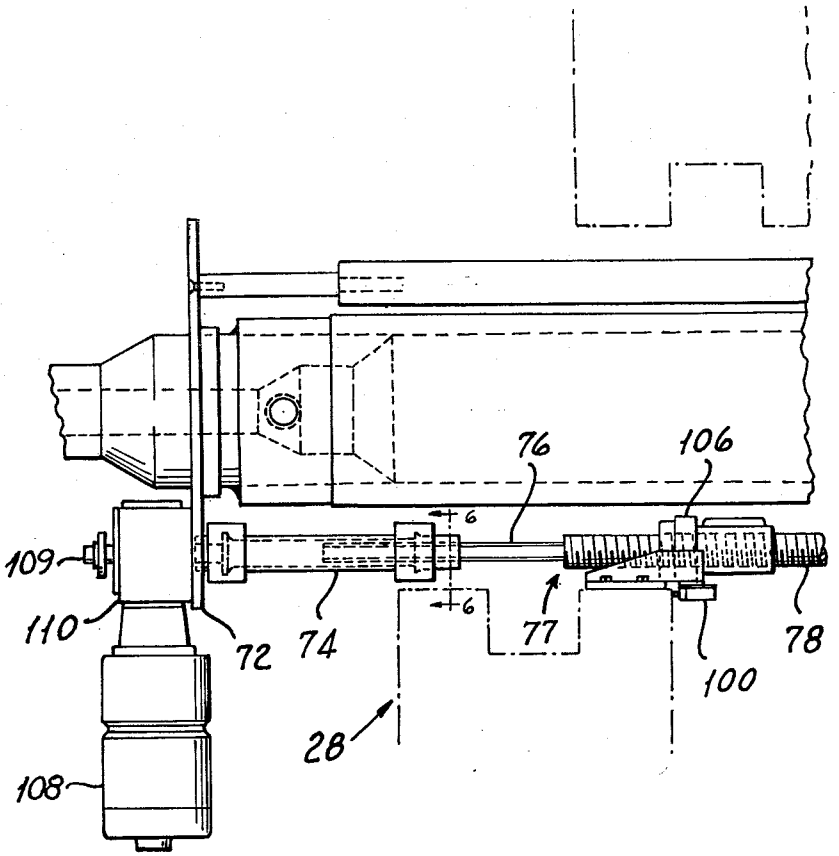
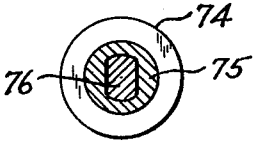
FIG. 6

TURRET FOR WINDERS AND UNWINDERS

BACKGROUND OF THE INVENTION

In the performance of many process operations, it is necessary that a web of materials such, for example, as paper or photographic film or the like be passed through a treating station. In the course of performing the operation, the material is unwound from a first roll, passed through the station and then wound on another roll. To facilitate the performance of these operations, there are known in the prior art turrets, each of which includes a cross-shaft supporting two pairs of arms extending generally diametrically oppositely from the shaft and the arms of each pair being spaced axially of the shaft. One turret is provided at the unwinding location and a second turret at the winding location. Generally, one pair of arms at the unwinding turret supports a roll being unwound while the other pair of arms supports a fresh roll which is to be moved to the operating position when the roll being unwound is depleted. Similarly, at the winding station, one pair of arms supports a core being wound and the other pair of arms supports an empty core which is moved to the winding position when the roll being wound is complete. To shift the rolls between the two positions and to provide for replacement of a roll or of a core, the cross-shaft is supported for rotary movement on the turret frame. The weight of a full roll is approximately 12,000 pounds and this weight must be supported at various angular positions of the cross-shaft on the turret frame.

In most turrets of the prior art, the support arms customarily are permanently secured to the cross-shaft. Under certain conditions, it is necessary that the cross-arms support a roll of a different width than that for which the turret was specifically designed. While this might be accomplished by the use of a mandrel, it is desirable that the arms be able to be moved axially of the shaft so as to support rolls of various widths without employing a mandrel. To achieve this result in the prior art, the cross-shaft has been machined to a fine finish and the turret arms have been fitted with sleeves of a bearing material such, for example, as bronze, cast iron, or the like, to permit sliding movement of the arms on the shaft. In order that torque will be transmitted from the turret arm to the cross-shaft, a key and a key-way must be provided.

In addition to the foregoing, it is also desirable that the width setting of one pair of arms be different from that of the other pair. In the prior art construction, the arm bushings surround the cross-shaft; and interference between arms precludes large differential width settings. A third requirement for turrets adapted to handle webs of material is that the roll be shifted back and forth so as automatically to align the edge of the web into the process equipment. This involves a continuous back-and-forth motion of the arms. Owing to the very large loads involved, this motion causes rapid wear of the bushings and development of backlash after a relatively short period of time in use. The large loads require a large motor to overcome the friction which decreases the accuracy of guiding.

We have invented an improved turret for winding and unwinding operations which overcomes the defects of turrets of the prior art pointed out hereinabove. Our improved turret permits the arms to accommodate rolls of different widths without the use of a mandrel. It permits the arms of one pair to handle a roll of a highly differing width than that being handled by the other pair. Our turret permits of automatic side-lay adjustment without excessive friction affording a longer life in use.

SUMMARY OF THE INVENTION

One object of our invention is to provide an improved turret for winding and unwinding which overcomes the defects of turrets of the prior art.

Another object of our invention is to provide an improved turret wherein the arms are eccentrically mounted on the cross-shaft.

Another object of our invention is to provide an improved turret provided with means for independently moving the respective pairs of arms axially of the cross-shaft.

Still another object of our invention is to provide an improved turret having means for concomitantly moving the roll supporting arms of a pair toward or away from each other.

A further object of our invention is to provide an improved turret having means for concomitantly moving the roll supporting arms of each pair back-and-forth along the cross-shaft.

A still further object of our invention is to provide an improved turret having a longer life in use than do turrets of the prior art.

Other and further objects of our invention will appear from the following description.

In general, our invention contemplates the provision of a turret assembly having respective arrangements of rolling bearings which eccentrically mount the core supporting arms for linear movement along the cross-shaft and for rotary movement with the cross-shaft. Respective independently operable means associated with the pairs of arms move the arms of a pair concomitantly toward or away from each other. Second independently operable means associated with the pairs of arms move the arms of a pair together back-and-forth along the cross-shaft.

BRIEF DESCRIPTION OF THE DRAWINGS

In the accompanying drawings which form part of the instant specification and in which like parts are indicated by like characters in the various views:

FIG. 3 is a fragmentary sectional view taken along the line 3—3 of FIG. 1.

FIG. 5 is a fragmentary front view with parts broken away showing the mechanism for driving one pair of arms.

FIG. 6 is a sectional view taken along the line 6—6 of FIG. 5.

FIG. 7 is a sectional view taken along the line 7—7 of FIG. 5.

DESCRIPTION OF THE PREFERRED EMBODIMENT

Figure 1:
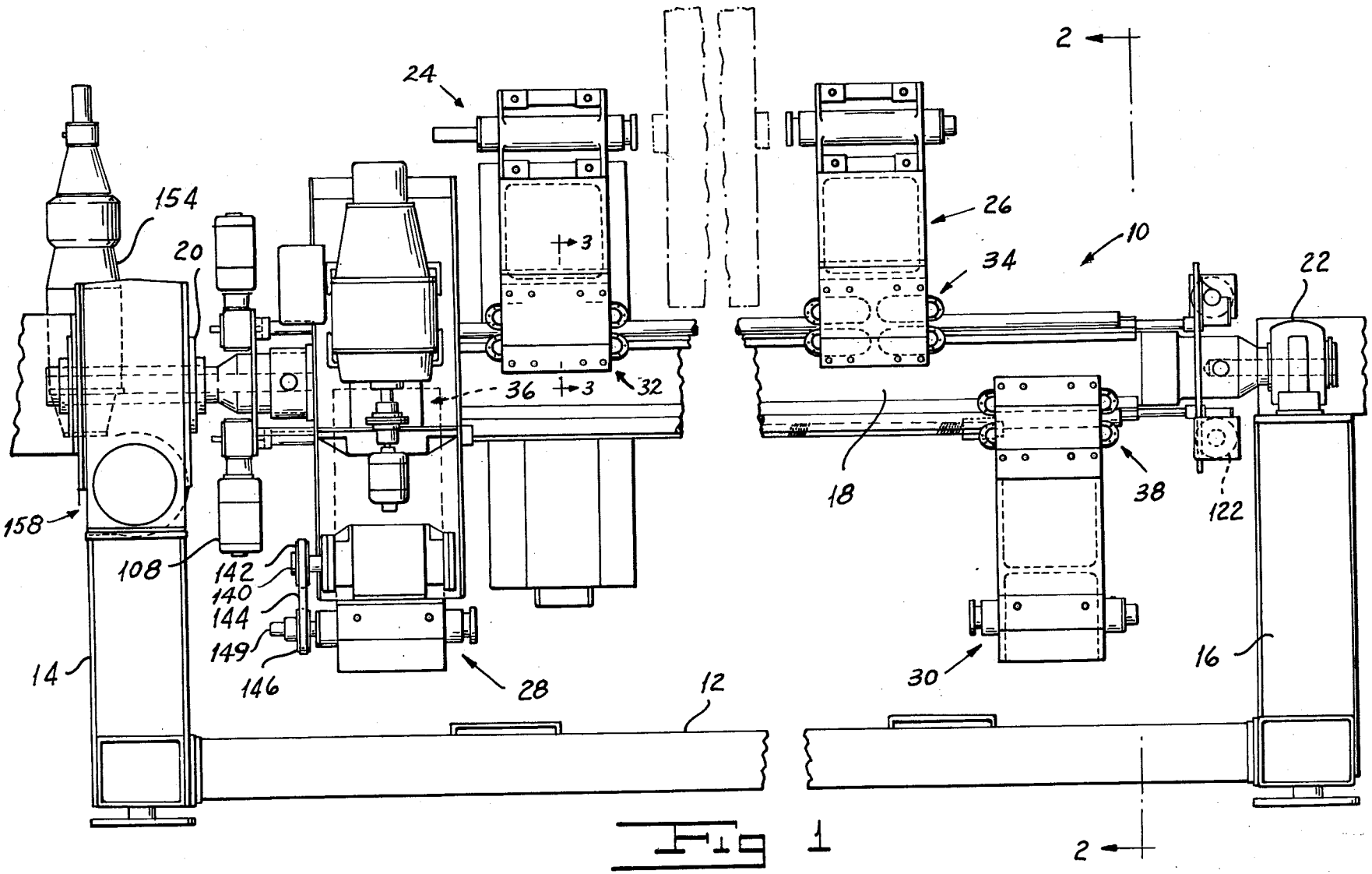
FIG. 1 is a front elevation of our improved turret for winding and unwinding operations.

Referring now to the drawings, our improved turret indicated generally by the reference character 10 includes a frame having a base 12 and a pair of uprights 14 and 16. The cross-shaft 18 of our turret is supported in bearings 20 and 22 carried by the respective uprights 14 and 16. The turret 10 includes a first pair of roll supporting arms 24 and 26 and a second pair of roll supporting arms 28 and 30. As is known in the art, the arms 24 and 26 of one pair extend in general diametrical opposition to arms 28 and 30. Moreover, in normal operation of the apparatus, one pair of arms will support an active roll which is either being wound or unwound and the other pair of arms will support a fresh roll to be unwound or a fresh core on which a roll is to be wound. While our apparatus is equally adapted to either a winding or an unwinding operation, we have illustrated it in connection with an unwinder. Cross-shaft 18 is rotationally driven by means of a motor 154 coupled to a gear reducer indicated generally by the reference character 158 mounted on upright 14.

Respective arm supporting assemblies indicated generally by the reference characters 32 and 34 mount the arms 24 and 26 on the cross-shaft 18. Arm supporting assemblies indicated generally by the reference characters 36 and 38 mount the arms 28 and 30 on shaft 18. Since all of the assemblies 32, 34, 36 and 38 are substantially identical, only assembly 32 will be described in detail.

Referring now to FIG. 3, we secure a pair of V-blocks 40 and 42 along the length of shaft 18 by any suitable means such, for example, by welding or the like. Bolts 48 secure elongated cylindrical rods 44 and 46 in the recesses of respective V-blocks 40 and 42. It will readily be appreciated that the rods 44 and 46 extend from a location adjacent one end of the cross-shaft 18 to a location adjacent the other end thereof. Moreover, the pair of rods 44 and 46 are associated not only with the mounting assembly 32 for arm 24 but also the mounting assembly 34 for arm 26. We provide the arm 24 with a generally rectangular recess 54 at the root or base thereof. Any suitable means such, for example, as bolts 51 or the like secure bearing supporting brackets 50 and 52 in the sides of the rectangular recess 54. Bracket 50 is provided with recesses 69 to receive rolling bearings 56 and 60; and bracket 52 is provided with recesses 70 to receive rolling bearings 58 and 62. Each of the bearings 56, 58, 60 and 62 includes a member 64 having a cylindrical central portion and hemispherical end portions, the central portion having the same radius as rods 44 and 46. Each of members 64 receives an endless chain including a plurality of rollers 66 which are contoured to conform to the cylindrical surface of the central portion. We provide bolts 68 for securing the members 64 in recesses 69 and 70 thus to position the bearings 56, 58, 60 and 62.

As can be seen by reference to FIG. 3, rods 44 and 46 subtend an angle of about 70° relative to the axis of shaft 18. Moreover, the pair of bearings 56 and 60 associated with rod 44 are spaced by 90° with relation to the axis of the rod as are the pair of bearings 58 and 62 associated with the rod 46. Owing to this arrangement, the arm 24 can be moved axially along the shaft 18 with a rolling movement provided by the bearing arrangement. At the same time, owing to the arrangement of bearings, the arm 24 will rotate with the shaft when the shaft 18 is driven around its axis. All this is accomplished while at the same time supporting the great weight of a full roll of approximately 12,000 pounds.

It is desired that rods 44 and 46 subtend a large angle of at least 45° relative to the axis of shaft 18. This provides a large linear distance between the rods which reduces the loading on the bearings. However, the angular separation must be appreciably less than 180° so that the lower end of arm 24 is somewhat above the axis of shaft 18. It will be understood that the upper end of depending arm 28 is somewhat below the axis of shaft 18. Accordingly arms 24 and 28 may be moved to the same or to widely differing axial positions on the cross-shaft without interference with one another. Bearings 60 and 56 contact rod 44 at points such that the angles relative to the axis of rod 44 between such points and a line joining the axes of rods 44 and 46 are respectively plus and minus 135°. Similarly bearings 58 and 62 contact rod 46 at points making respective angles of plus and minus 135° relative to the axis of rod 46 and a line joining the rod axes. The arrangement minimizes bearing loads.

Figure 4:
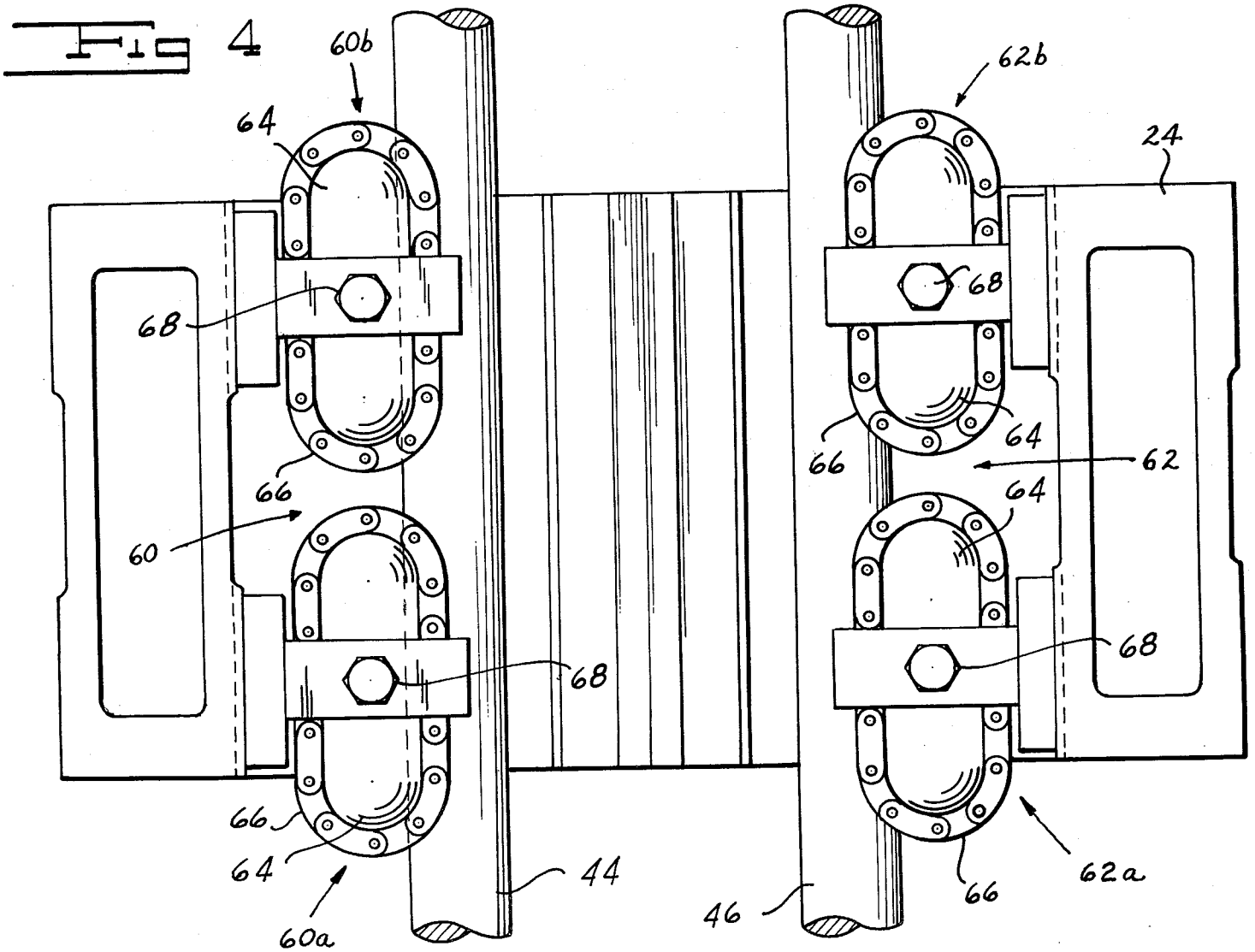
FIG. 4 is a fragmentary bottom view taken along the line 4—4 of FIG. 3.

As may be seen by reference to FIG. 4, bearing means 60 comprise two axially spaced bearings 60*a* and 60*b* and bearing means 62 comprises two axially spaced bearings 62*a* and 62*b*. It will be understood however that bearings 60 and 62 may instead comprise greatly elongated single bearing assemblies.

As has been pointed out hereinabove, we provide each pair of arms of our turret with means for moving the arms of the pair together or apart and with means for moving the arms simultaneously from side-to-side along the cross-shaft 18. Referring now to FIG. 5, we secure a mounting plate 72 to the shaft 18 adjacent upright 14. Attached to plate 72 is a gear reduction drive 110 having an output shaft 109 which extends inwardly from plate 72 and carries a quill 74. A roll width adjusting motor 108 is mounted upon gear reducer 110 and drives an input shaft thereof. The inboard end of quill 74 supports a sleeve 75, the interior of which is formed with a bore of non-circular cross section. Member 75 receives a shaft 77 provided with an end portion 76 of non-circular sectional shape, complementary to that of the bore in the sleeve 75. It will thus be appreciated that shaft 77 will rotate in response to rotation of quill 74. Nevertheless, the coupling provided by the sleeve 75 permits shaft portion 76 to telescope within quill 74. Shaft 77 is provided with a left-hand threaded portion 78 and a right-hand threaded portion 80 adjacent the respective sides of the turret. The end of shaft 77 is received in thrust bearings indicated generally by the reference character 82 mounted in one end of a quill 84, the other end of which carries a nut 86. Nut 86, in turn, receives a jack screw 88 rotatably supported in a mounting plate 90 secured to the cross-shaft 18 adjacent upright 16. The left-hand threaded portion 78 of the arm adjusting shaft 77 receives a travelling nut 106 which is secured to arm 28. The right-hand threaded portion 80 receives a travelling nut 107, which is secured to arm 30. Travelling nuts 106, 107, and 86 are preferably provided with recirculating balls to reduce friction and hence wear and resulting backlash in the adjusting mechanism.

As may best be seen by reference to FIG. 7, a member 81 carrying an upstanding stub shaft is secured to the periphery of quill 84 by welding or the like. The stub shaft of member 81 mounts a ball bearing 83, the outer race of which rides in an inverted U-channel 19, which is secured to the periphery of cross-shaft 18 by welding or the like. Channel 19 may have a length of at least six inches to accommodate a corresponding amount of side lay adjustment.

A side lay adjusting motor 112 is secured to a bracket 113 mounted on plate 90. Motor 112 drives a pulley 114 which, through a belt 116, drives a pulley 118 secured to the input shaft 120 of a gear reducer 122 also attached to plate 90. The output of gear reducer 122 drives lead screw 88.

Adjustment of roll width is accomplished by actuation of motor 108. The output shaft 109 of gear reducer 110 rotates, producing corresponding rotation of quill 74 and shaft 77. Rotation of the left-hand and right-hand lead screw portions 78 and 80 in one direction causes arms 28 and 30 to move apart relative to one another, thereby accommodating rolls of a greater width, while rotation of the lead screw portions 78 and 80 in the opposite direction causes arms 28 and 30 to approach each other, thereby accommodating rolls of a lesser width. During the course of this width adjustment, the right-hand end of shaft 77 is fixed axially by thrust bearings 82 so that no change in side lay will occur.

In order to adjust side lay, motor 112 is actuated, which through members 114, 116, 118, 120, and 122 causes rotation of lead screw 88. Quill 84 is restrained against rotation by bearing 83 which rides along one leg of the inverted U-channel 19. Rotation of lead screw 88 thus results in an axial motion of travelling nut 86, quill 84, and thrust bearings 82. This axially shifts the position of shaft 77, producing a corresponding axial shift in the positions of nuts 106 and 107 and hence of arms 28 and 30. During the course of this axial shift, shaft portion 76 telescopes within quill 74. Limit switches such as 100 and 101 are preferably provided to prevent excessive axial movement of arms 28 and 30 in response to actuation of either or both of adjusting motors 108 and 112.

Figure 2:
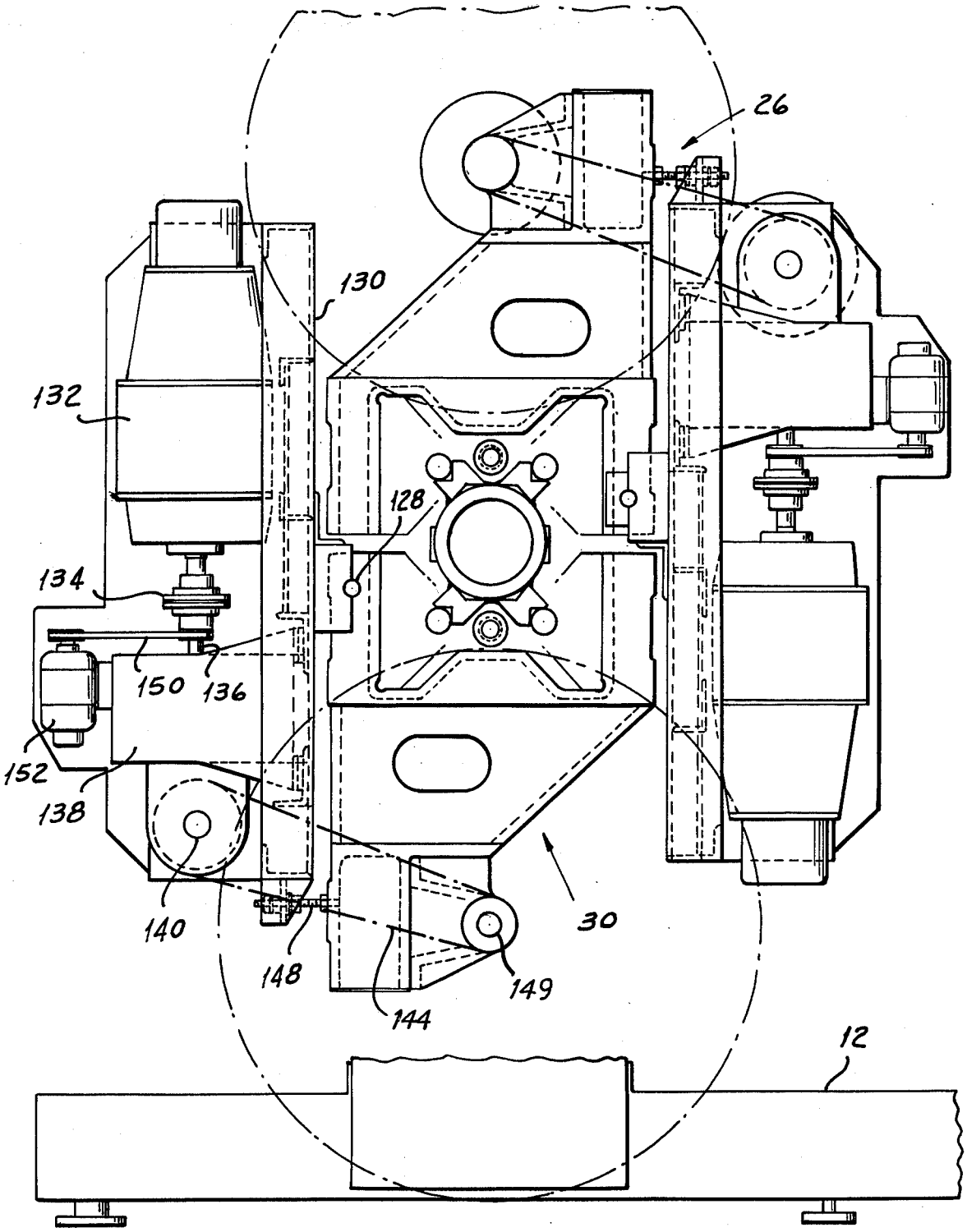
FIG. 2 is a fragmentary side view with parts broken away taken along the line 2—2 of FIG. 1.
Figure 1:
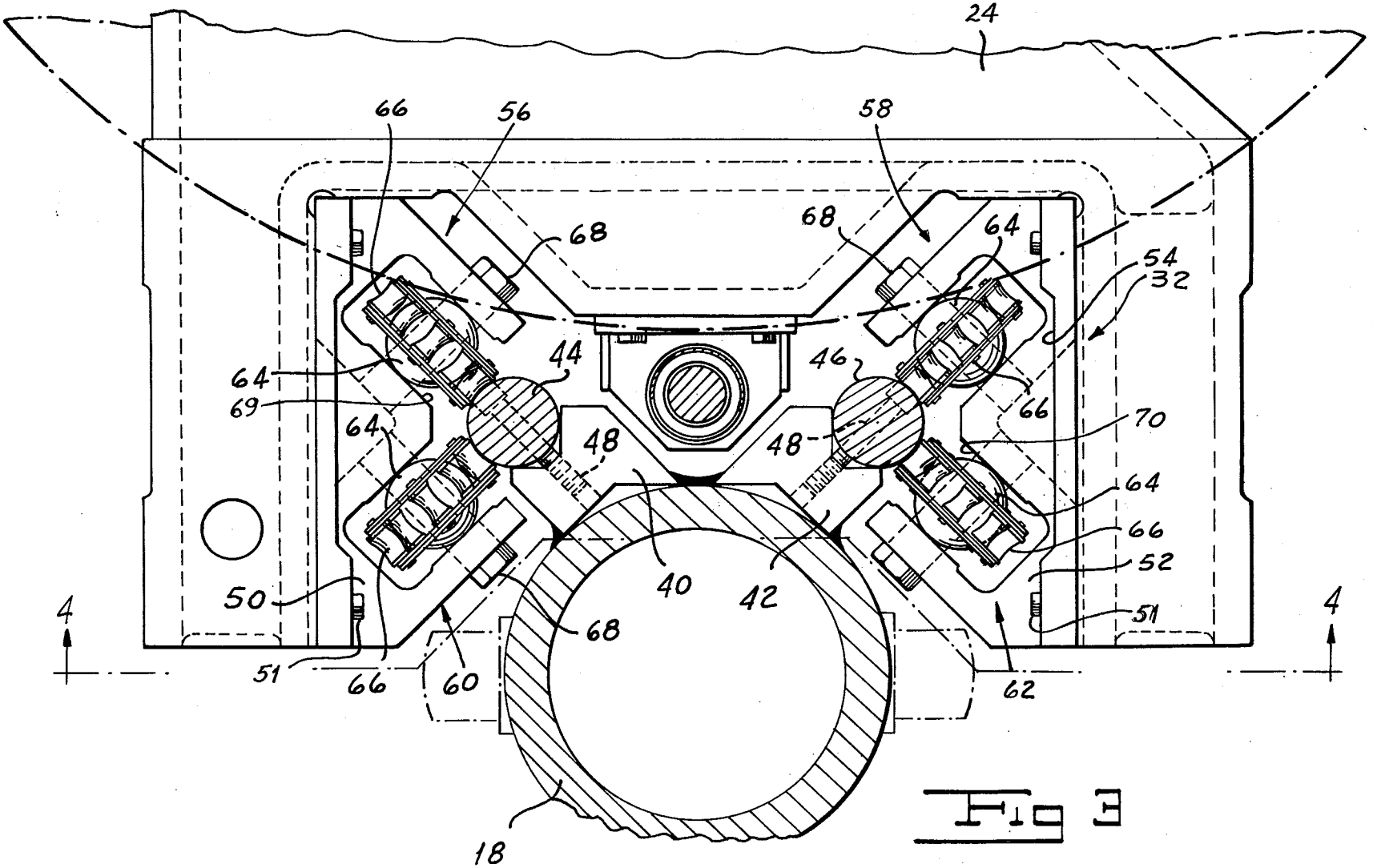

Referring now to FIGS. 2 and 1, we have shown means for driving the rolls during the course of a winding or unwinding operation. A frame 130 is pivotally secured to a shaft 128 mounted on arm 28. A roll drive motor 132 drives the input shaft 136 of a gear reducer 138 through a coupling 134. The gear reducer input shaft 136 drives a tachometer rate generator 152 through a belt 150. The output shaft 140 of gear reducer 138 mounts a pulley 142 which, through a belt 144, drives a pulley 146 mounted on a shaft 149. Shaft 149 is rotatably mounted in arm 28 and supports one end of the core upon which the web is being wound or unwound. Proper tension in belt 144 is obtained by a take-up adjustment 148 which provides small angular movements of frame 130 about shaft 128 relative to arm 28 in order to vary the distance between shafts 140 and 149.

It will be seen that we have accomplished the objects of our invention. We have provided an improved turret in which each arm is provided with linear bearings affording substantially friction-free axial movement of the arms while sustaining rolls weighing six tons. In our turret, the arms are eccentrically mounted on the cross-shaft so that the upper arms can be moved axially without interferring with the lower arms. In our improved turret, a pair of arms are simultaneously moved either toward one another or away from one another to adjust roll width, without disturbing side lay. Furthermore, a pair of arms may be moved synchronously in either one axial direction or the other to adjust side lay, without disturbing the roll width adjustment.

It will be understood that certain features and subcombinations are of utility and may be employed without reference to other features and subcombinations. This is contemplated by and is within the scope of our claims. It will be further understood that various changes may be made in details within the scope of our claims without departing from the spirit of our invention. It is therefore to be understood that our invention is not to be limited to the specific details shown and described.

Having thus described our invention, what we claim is:

1. In a winding or unwinding turret, apparatus including a roll stand, a main shaft, means mounting said main shaft on said stand for rotary movement around an axis, a roll supporting arm, and means including a pair of rolling bearing means angularly spaced around said shaft for mounting said arm on said shaft for rotary movement therewith and for movement in the direction of said axis, said arm mounting means including a pair of rods extending in a direction generally parallel to said axis, said rods being angularly spaced around said axis, each of said rods having spaced arcuate surface portions therearound, and in which said rolling bearing means comprise a first pair of linear rolling bearings in engagement with the arcuate portions of the first rod, and a second pair of linear rolling bearings in engagement with the arcuate portions of the second rod.

2. In a winding or unwinding turret apparatus including a roll stand, a main shaft, means mounting said main shaft on said stand for rotary movement around an axis, a roll supporting arm, a pair of cylindrical rods, means mounting said rods on one of said shaft and said arm at circumferentially spaced locations around said shaft and with the longitudinal axes thereof generally parallel to said shaft axis, and respective rolling bearing means between said rods and the other of said shaft and said arm for mounting said arm on said shaft for rotary movement therewith and for movement in the direction of said shaft axis.

3. Apparatus as in claim 2 in which said rolling bearing means includes a first pair of rolling bearings engaging one of said rods at circumferentially spaced locations and a second pair of rolling bearings engaging the other of said rods at circumferentially spaced locations.

4. Apparatus as in claim 3 in which said bearing means comprise linear bearings having rolling elements which support said arm for movement in the direction of said axis.

5. Apparatus as in claim 2 including a second roll supporting arm and second respective rolling bearing means between said other of said shaft and said arm for mounting said second arm on said shaft for rotary movement therewith and for movement in the direction of said shaft axis.

6. Apparatus as in claim 5 including first means for concomitantly moving said roll arms toward each other and away from each other and second means for moving said arms in the same direction along said shaft.

7. A turret for winders and unwinders including in combination a cross-shaft having an axis, a first and a second rod each having an axis, means mounting the first and second rods on the shaft such that the rod axes are parallel to the shaft axis and subtend an angle relative thereto which is greater than 45° but appreciably less than 180°, a core supporting arm, means including four linear bearing means for mounting the arm on the rods, each bearing means comprising recirculating rolling elements which contact a rod, a first of said bearing means contacting the first rod in a region such that the angle relative to the axis thereof between said region and a line joining the axes of the rods is approximately +135°, a second bearing means contacting the first rod in a region such that the angle relative to the axis thereof between said region and said line is approximately −135°, a third bearing means contacting the second rod in a region such that the angle relative to the axis thereof between said region and said line is approximately +135°, and the fourth of said bearing means contacting the second rod in a region such that the angle relative to the axis thereof between said region and said line is approximately −135°.

8. A turret as in claim 7 wherein each bearing means comprises two axially spaced linear bearings.

* * * * *